US007880386B2

(12) United States Patent
Kim

(10) Patent No.: US 7,880,386 B2
(45) Date of Patent: Feb. 1, 2011

(54) PLASMA DISPLAY PANEL

(75) Inventor: Dohwan Kim, Cheongju-si (KR)

(73) Assignee: LG Electronics Inc., Seoul (KR)

( * ) Notice: Subject to any disclaimer, the term of this patent is extended or adjusted under 35 U.S.C. 154(b) by 6 days.

(21) Appl. No.: 12/421,066

(22) Filed: Apr. 9, 2009

(65) Prior Publication Data

US 2009/0256479 A1 Oct. 15, 2009

(30) Foreign Application Priority Data

Apr. 11, 2008 (KR) ..... 10-2008-0033918

(51) Int. Cl.
*H01J 17/49* (2006.01)

(52) U.S. Cl. ..... 313/582; 313/586

(58) Field of Classification Search ..... 313/582, 313/584, 586

See application file for complete search history.

(56) References Cited

FOREIGN PATENT DOCUMENTS

| | | |
|---|---|---|
| JP | 2000-016834 A | 1/2000 |
| JP | 2003-173742 A | 6/2003 |
| JP | 2003-217464 A | 7/2003 |

*Primary Examiner*—Vip Patel
(74) *Attorney, Agent, or Firm*—KED & Associates, LLP

(57) ABSTRACT

A plasma display panel is disclosed. The plasma display panel includes a front substrate, a rear substrate facing the front substrate, barrier ribs positioned in an active area, and a sealant disposed between the front substrate and the rear substrate in a dummy area. The rear substrate includes a dielectric layer. The dielectric layer in the dummy area includes a first portion having a first thickness and a second portion having a second thickness. The first thickness is different from the second thickness.

20 Claims, 8 Drawing Sheets

(a)

(b)

PLASMA DISPLAY PANEL

This application claims the benefit of Korean Patent Application No. 10-2008-0033918 filed on Apr. 11, 2008, the entire contents of which is hereby incorporated by reference.

BACKGROUND

1. Field of the Invention

Exemplary embodiments relate to a plasma display panel.

2. Description of the Related Art

A plasma display panel includes a phosphor layer inside discharge cells partitioned by barrier ribs and a plurality of electrodes.

When driving signals are applied to the electrodes of the plasma display panel, a discharge occurs inside the discharge cells. In other words, when a discharge occurs inside the discharge cells due to the driving signals, a discharge gas filled in the discharge cells generates vacuum ultraviolet rays, which thereby cause phosphors positioned between the barrier ribs to emit light, and then visible light is generated. An image is displayed on the screen of the plasma display panel by the visible light.

SUMMARY OF THE INVENTION

Exemplary embodiments provide a plasma display panel including a dielectric layer including a plurality of portions each having a different thickness.

Additional features and advantages of the exemplary embodiments of the invention will be set forth in the description which follows, and in part will be apparent from the description, or may be learned by practice of the exemplary embodiments of the invention. The objectives and other advantages of the exemplary embodiments of the invention will be realized and attained by the structure particularly pointed out in the written description and claims hereof as well as the appended drawings.

In one aspect, there is a plasma display panel including a front substrate, a rear substrate facing the front substrate, the rear substrate including a dielectric layer thereon, barrier ribs positioned in an active area, and a sealant disposed between the front substrate and the rear substrate in a dummy area, wherein the dielectric layer in the dummy area includes a first portion having a first thickness T1 and a second portion having a second thickness T2, the first thickness T1 being different from the second thickness T2.

The first thickness T1 may be greater than the second thickness T2.

The sealant may include a plurality of beads.

The first thickness T1 may be substantially equal to a thickness of the dielectric layer in the active area.

The sealant directly may contact the second portion.

The second portion may be disposed between the sealant and the barrier ribs.

The plasma display panel may further include dummy barrier ribs between the second portion and the barrier ribs.

The dielectric layer may include a glass frit. The glass frit may include about 55 to 80 parts by weight of lead oxide (PbO), about 1 to 10 parts by weight of aluminum oxide ($Al_2O_3$), about 1 to 9 parts by weight of boron oxide ($B_2O_3$), about 8 to 40 parts by weight of silicon oxide ($SiO_2$), and about 0.1 to 12 parts by weight of bismuth oxide ($Bi_2O_3$) based on 100 parts by weight of the glass frit.

The first thickness T1 and the second thickness T2 may substantially satisfy the following equation: $0.538 \leqq T2/T1 \leqq 0.995$.

The first thickness T1 and the second thickness T2 may substantially satisfy the following equation: $0.846 \leqq T2/T1 \leqq 0.995$.

It is to be understood that both the foregoing general description and the following detailed description are exemplary and explanatory and are intended to provide farther explanation of embodiments of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail embodiments of the invention examples of which are illustrated in the accompanying drawings.

Figure 1:
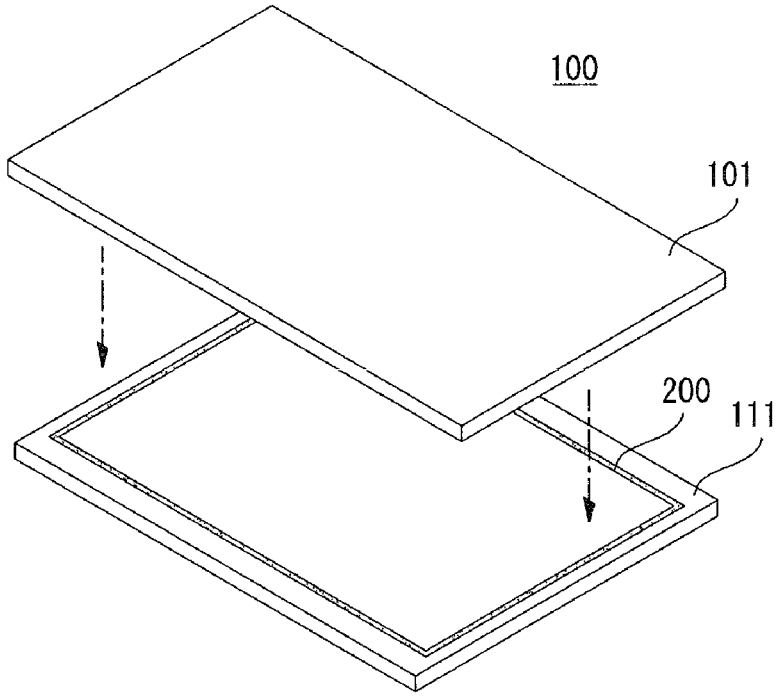
FIGS. 1 and 2 illustrate a structure of a plasma display panel according to an exemplary embodiment.
Figure 1:
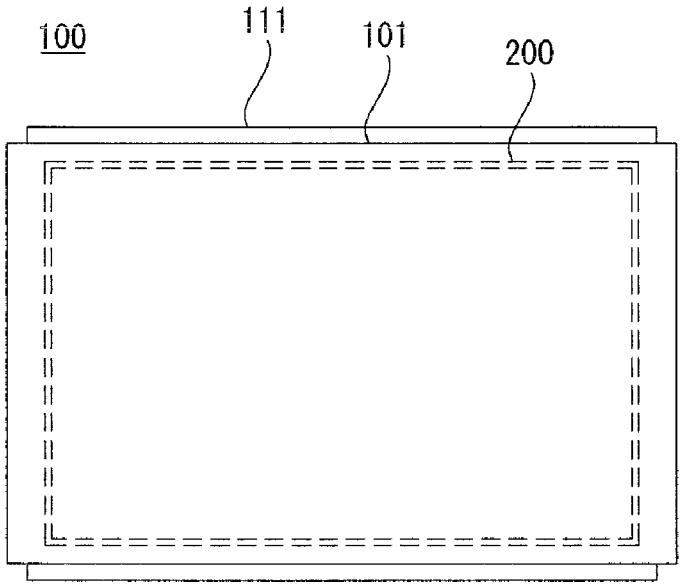
Figure 2:
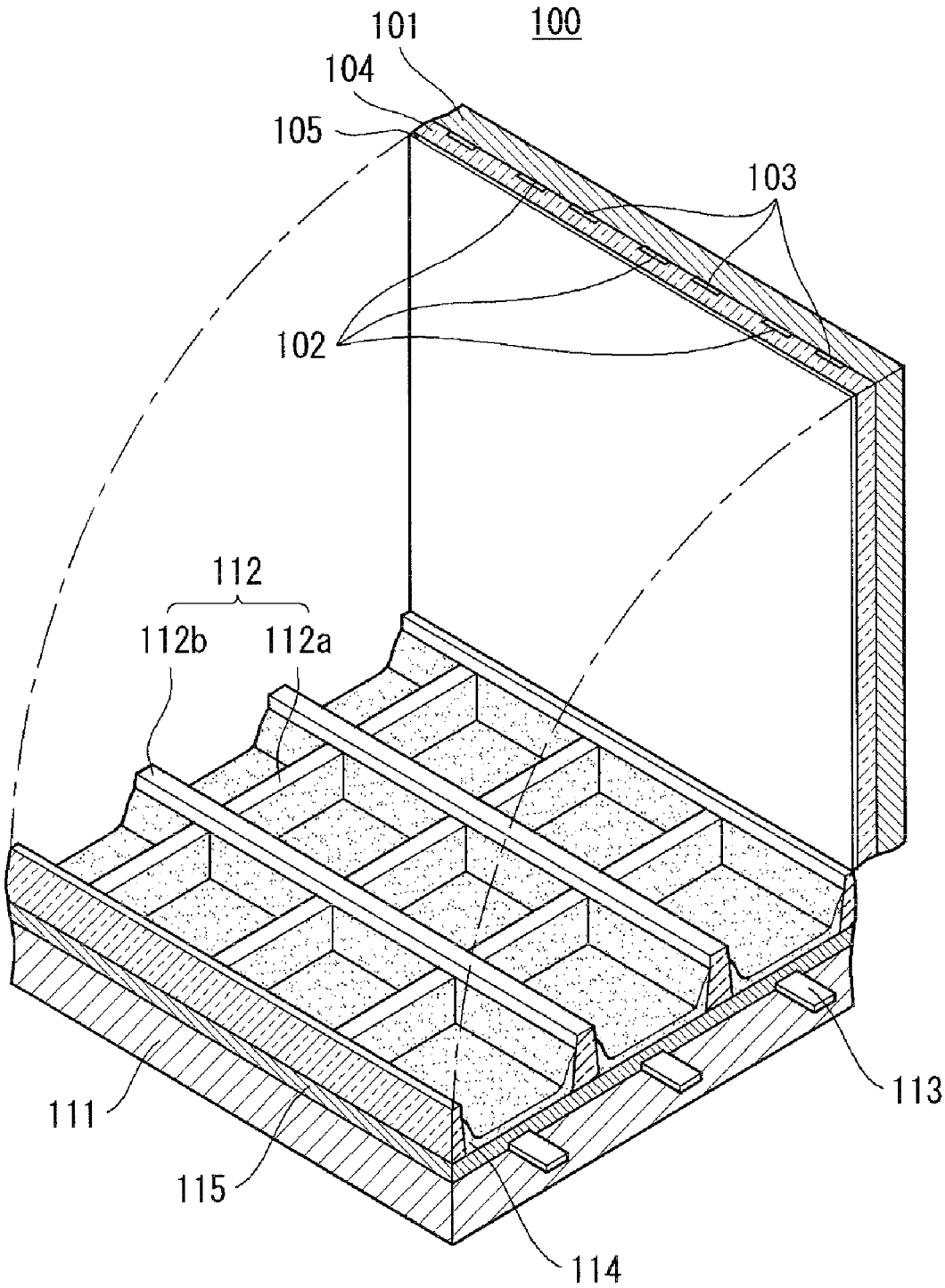

FIGS. 1 and 2 illustrate a structure of a plasma display panel according to an exemplary embodiment.

As shown in FIG. 1, a plasma display panel 100 may include a front substrate 101, a rear substrate 111, and a sealant 200 between the front substrate 101 and the rear substrate 111.

The sealant 200 may attach the front substrate 101 to the rear substrate 111 to seal a discharge space between the front substrate 101 and the rear substrate 111.

FIG. 2 shows in detail a structure of the plasma display panel 100.

As shown in FIG. 2, the plasma display panel 100 may include the front substrate 101, on which a scan electrode 102 and a sustain electrode 103 are positioned parallel to each other, and the rear substrate 111 on which an address electrode 113 is positioned to intersect the scan electrode 102 and the sustain electrode 103.

An upper dielectric layer 104 may be formed on the scan electrode 102 and the sustain electrode 103 to limit a discharge current of the scan electrode 102 and the sustain electrode 103 and to provide insulation between the scan electrode 102 and the sustain electrode 103.

A protective layer 105 may be formed on the upper dielectric layer 104 to facilitate discharge conditions. The protective layer 105 may be formed of a material having a high secondary electron emission coefficient, for example, magnesium oxide (MgO).

A lower dielectric layer 115 may be formed on the address electrode 113 to provide insulation of the address electrodes 113.

Barrier ribs 112 may be formed on the lower dielectric layer 115 in a stripe-type, a well-type, a delta-type, or a honeycomb-type structure to partition discharge spaces (i.e., discharge cells). A first discharge cell emitting red light, a second discharge cell emitting blue light, and a third discharge cell emitting green light may be formed between the front substrate 101 and the rear substrate 111. In addition to the first, second, and third discharge cells, a fourth discharge cell emitting white or yellow light may be further formed.

Widths of the first, second, and third discharge cells may be substantially equal to one another. A width of at least one of the first, second, and third discharge cells may be different from widths of the other discharge cells. For example, the first discharge cell may have a minimum width, and widths of the second and third discharge cells may be greater than the width of the first discharge cell. The width of the second discharge cell may be substantially equal to or different from the width of the third discharge cell. Hence, a color temperature of an image displayed on the plasma display panel 100 may be improved.

The barrier rib 112 may include a first barrier rib 112*a* and a second barrier rib 112*b* crossing each other, and a height of the first barrier rib 112*a* may be different from a height of the second barrier rib 112*b*. The first barrier rib 112*a* may be parallel to a longer side of the rear substrate 111, and the second barrier rib 112*b* may be parallel to a short side of the rear substrate 111.

The barrier rib 112 may have various structures as well as the structure shown in FIG. 2. For example, there are a channel type barrier rib structure in which a channel usable as an exhaust path is formed on at least one of the first barrier rib 112*a* or the second barrier rib 112*b*, a hollow type barrier rib structure in which a hollow is formed on at least one of the first barrier rib 112*a* or the second barrier rib 112*b*, and the like.

While FIG. 2 has shown and described the case where the first, second, and third discharge cells are arranged on the same line, the first, second, and third discharge cells may be arranged in a different pattern. For example, a delta type arrangement in which the first, second, and third discharge cells are arranged in a triangle shape may be applicable. Further, the discharge cells may have a variety of polygonal shapes such as pentagonal and hexagonal shapes as well as a rectangular shape.

While FIG. 2 has shown the case where the barrier ribs 112 are formed on the rear substrate 111, the barrier ribs 112 may be formed on at least one of the front substrate 101 or the rear substrate 111.

Each of the discharge cells partitioned by the barrier ribs 112 may be filled with a discharge gas.

A phosphor layer 114 may be formed inside the discharge cells to emit visible light for an image display during an address discharge. For example, first, second, and third phosphor layers that respectively generate red, blue, and green light may be formed inside the discharge cells. In addition to the first, second, and third phosphor layers, a fourth phosphor layer generating white and/or yellow light may be further formed.

A thickness of at least one of the first, second, and third phosphor layers may be different from thicknesses of the other phosphor layers. For example, a thickness of the second phosphor layer or the third phosphor layer may be greater than a thickness of the first phosphor layer. The thickness of the second phosphor layer may be substantially equal or different from the thickness of the third phosphor layer.

While FIG. 2 has shown the case where the upper dielectric layer 104 and the lower dielectric layer 115 each have a single-layered structure, at least one of the upper dielectric layer 104 and the lower dielectric layer 115 may have a multi-layered structure.

A black layer (not shown) capable of absorbing external light may be further formed on the barrier rib 112 to prevent the external light from being reflected by the barrier rib 112.

Further, another black layer (not shown) may be further formed at a predetermined location of the front substrate 101 corresponding to the barrier rib 112.

While the address electrode 113 may have a substantially constant width or thickness, a width or thickness of the address electrode 113 inside the discharge cell may be different from a width or thickness of the address electrode 113 outside the discharge cell. For example, a width or thickness of the address electrode 113 inside the discharge cell may be greater than a width or thickness of the address electrode 113 outside the discharge cell.

Figure 3:
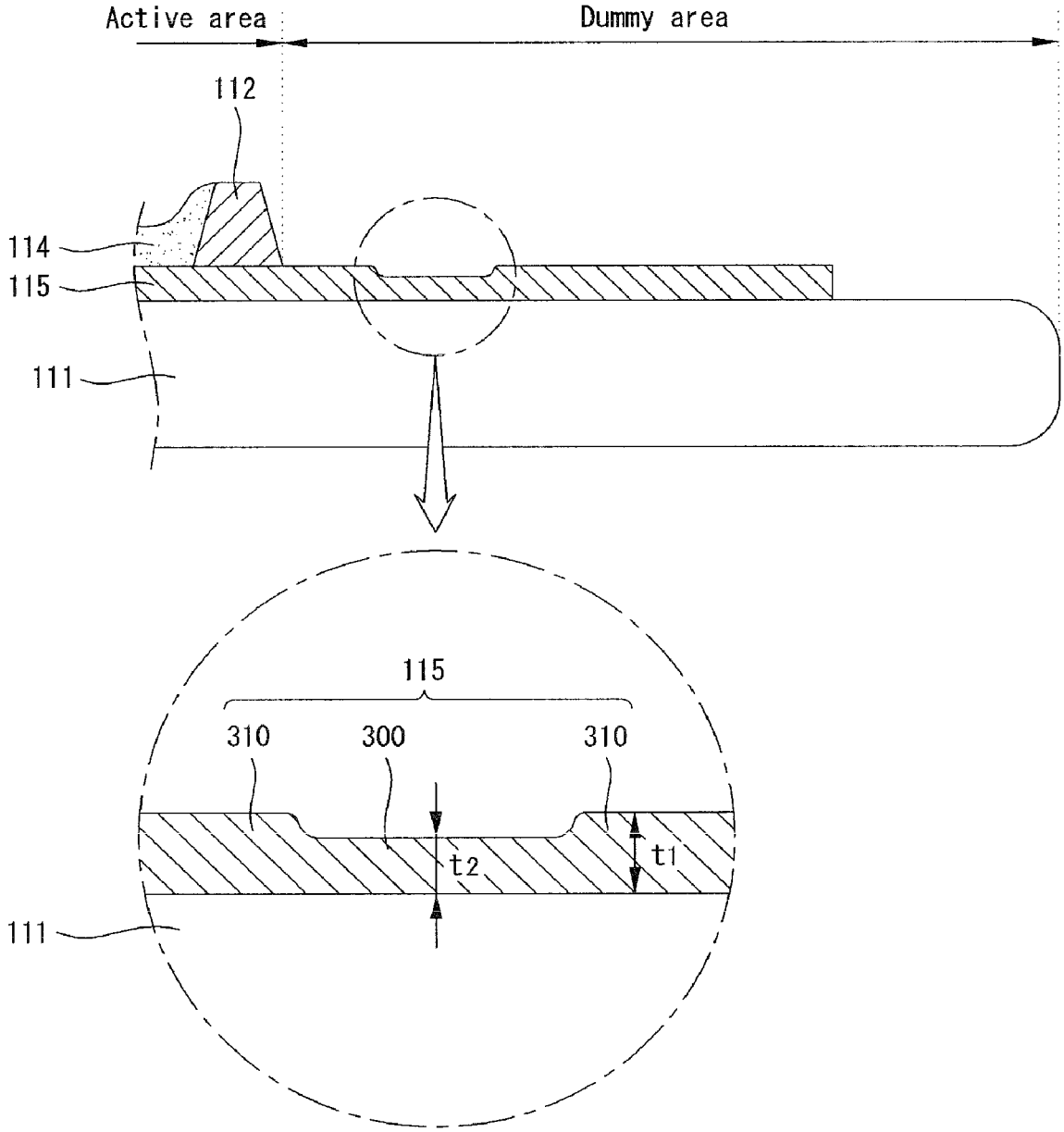
FIGS. 3 and 4 illustrate a dielectric layer of the plasma display panel.
Figure 4:
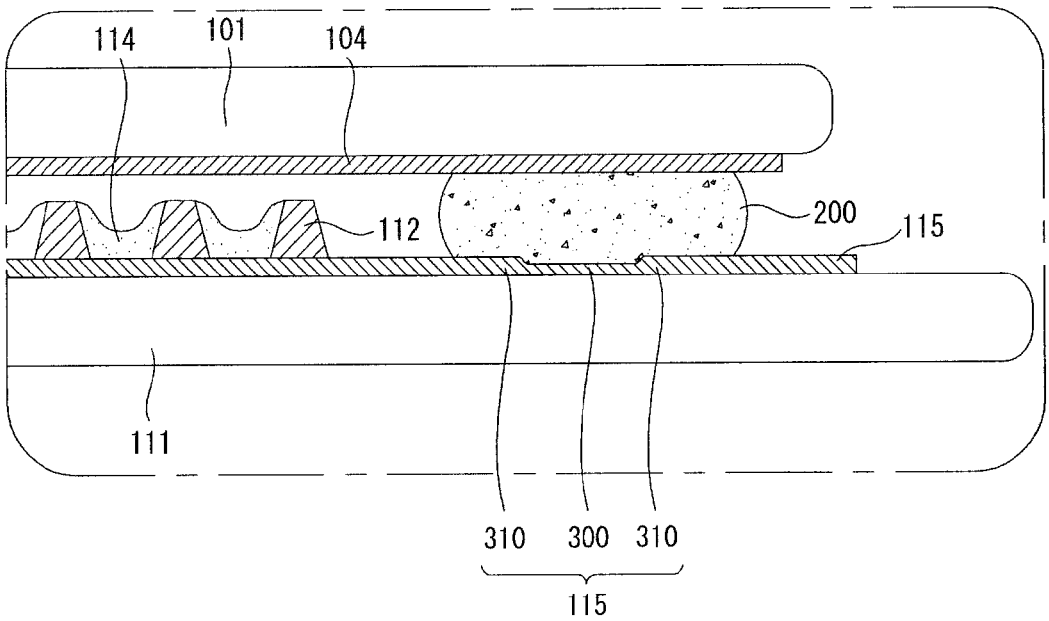

FIGS. 3 and 4 illustrate in detail a dielectric layer of the plasma display panel.

As shown in FIG. 3, the lower dielectric layer 115 may include a first portion 310 having a first thickness T1 and a second portion 300 having a second thickness T2 different from the first thickness T1.

The first portion 310 and the second portion 300 may be positioned in a dummy area outside an active area where the barrier ribs 112 are positioned.

The first thickness T1 may be greater than the second thickness T2. The first thickness T1 may be substantially equal to a thickness of the lower dielectric layer 115 of the active area.

As shown in FIG. 4, the second portion 300 of the lower dielectric layer 115 may directly contact the sealant 200. The direct contact may increase a contact area between the sealant 200 and the lower dielectric layer 115. Hence, an attachment strength between the front substrate 101 and the rear substrate 111 may be improved.

Figure 5:
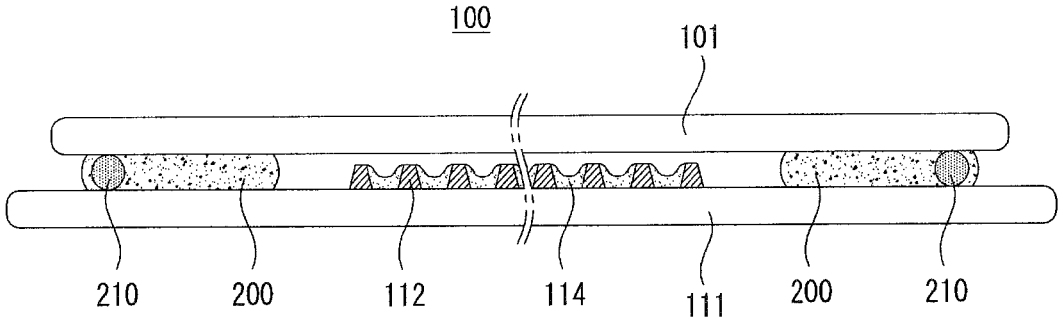
FIG. 5 illustrates an example where beads are included in a sealant.

FIG. 5 illustrates an example where beads are included in the sealant.

As shown in FIG. 5, the sealant 200 between the front substrate 101 and the rear substrate 111 may include a plurality of beads 210. The beads 210 may keep a distance between the front substrate 101 and the rear substrate 111 substantially constant and prevent a collision between the front substrate 101 and the barrier ribs 112 that may be frequently generated during a drive of the plasma display panel 100. Hence, a generation of noise may be reduced.

The beads 210 may be formed of a material having a strength enough to endure a pressure applied by the front substrate 101 and the rear substrate 111. The beads 210 may be formed of a material that is not melted when the sealant 200 is fired. For example, the beads 210 may be formed of metal, plastic, glass, and silicon having a melting point equal to or higher than 500° C. Other materials may be used for the beads 210.

The first thickness T1 and the second thickness T2 of the lower dielectric layer 115 will be below described in detail with reference to Table 1 and FIGS. 6 to 9.

Table 1 and FIGS. 6 to 9 show changes in the structure of the plasma display panel depending on changes in the thicknesses of the first and second portions.

The following Table 1 shows an attachment strength between the front substrate and the rear substrate and whether or not the address electrode is deformed when a ratio T2/T1 of the second thickness T2 to the first thickness T1 changes from 0.212 to 0.998. In Table 1, X, ○, and ◎ represent bad, good, and excellent states of characteristics, respectively. More specifically, represent that the attachment strength between the front substrate and the rear substrate is sufficient strong, or that the structural stability of the plasma display panel is excellent because the address electrode is not deformed. X represent that the attachment strength between the front substrate and the rear substrate is excessively weak, or that the structural stability of the plasma display panel is bad because the address electrode is deformed.

TABLE 1

| T2/T1 | Attachment Strength | Electrode Deformation |
|---|---|---|
| 0.212 | ◎ | X |
| 0.461 | ◎ | X |
| 0.538 | ◎ | ○ |
| 0.626 | ◎ | ○ |
| 0.753 | ◎ | ○ |
| 0.846 | ◎ | ◎ |
| 0.898 | ○ | ◎ |
| 0.942 | ○ | ◎ |
| 0.995 | ○ | ◎ |
| 0.998 | X | ◎ |

Figure 6:
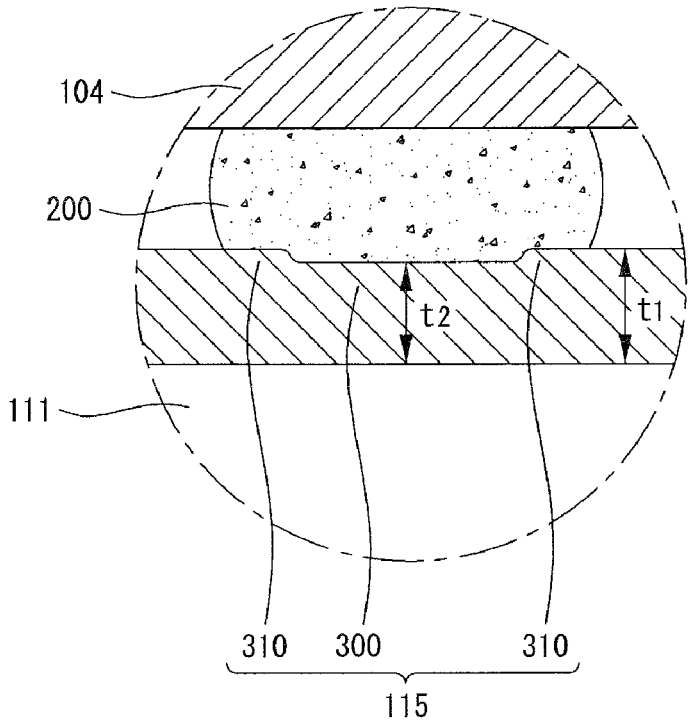
FIGS. 6 to 9 illustrates changes in a structure of the plasma display panel depending on changes in thicknesses of first and second portions.

As indicated in Table 1, when the ratio T2/T1 is 0.998, the attachment strength characteristic is bad. As shown in FIG. 6, because a difference between the second thickness T2 of the second portion 300 and the first thickness T1 of the first portion 310 is small, a contact area between the sealant 200 and the lower dielectric layer 115 may be small. Therefore, the attachment strength characteristic is bad.

When the ratio T2/T1 is 0.212 to 0.846, the attachment strength characteristic is excellent. Because the second thickness T2 of the second portion 300 is sufficiently smaller than the first thickness T1 of the first portion 310, a contact area between the sealant 200 and the lower dielectric layer 115 may widens. Therefore, the attachment strength characteristic is excellent.

When the ratio T2/T1 is 0.898 to 0.995, the attachment strength characteristic is good.

Figure 7:
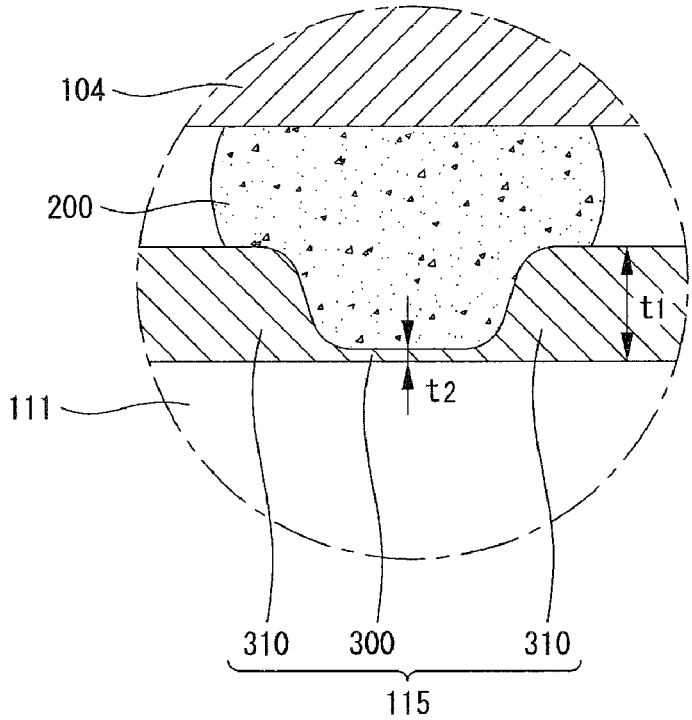
Figure 8:
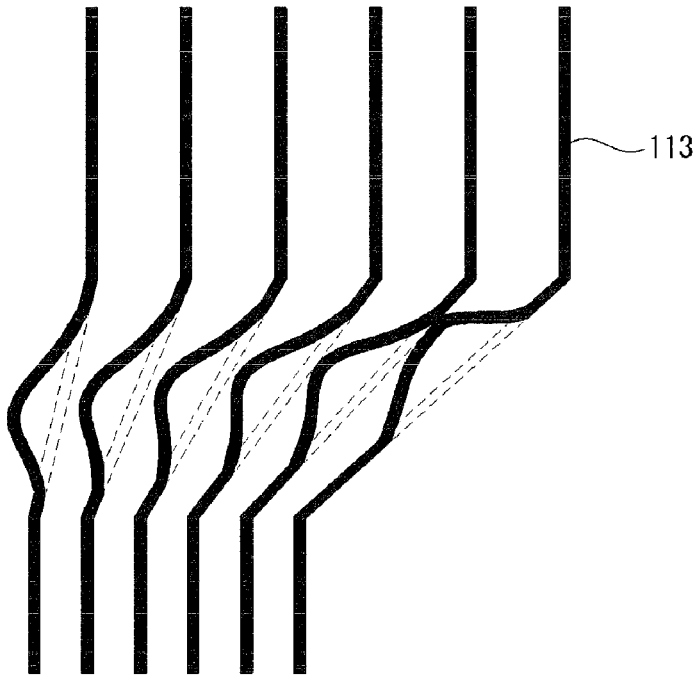

When the ratio T2/T1 is 0.212 to 0.461, the electrode deformation characteristic is bad. As shown in FIG. 7, because the second thickness T2 is excessively smaller than the first thickness T1, a pressure applied by the sealant 200 may be applied to the address electrodes 113 positioned under the lower dielectric layer 115. Hence, as shown in FIG. 8, the address electrodes 113 may be bent, and the bent address electrodes 113 adjacent to one another may be shorted. Further, as shown in FIG. 9, the address electrodes 113 may be broken because of a pressure applied by the beads 310

Figure 9:
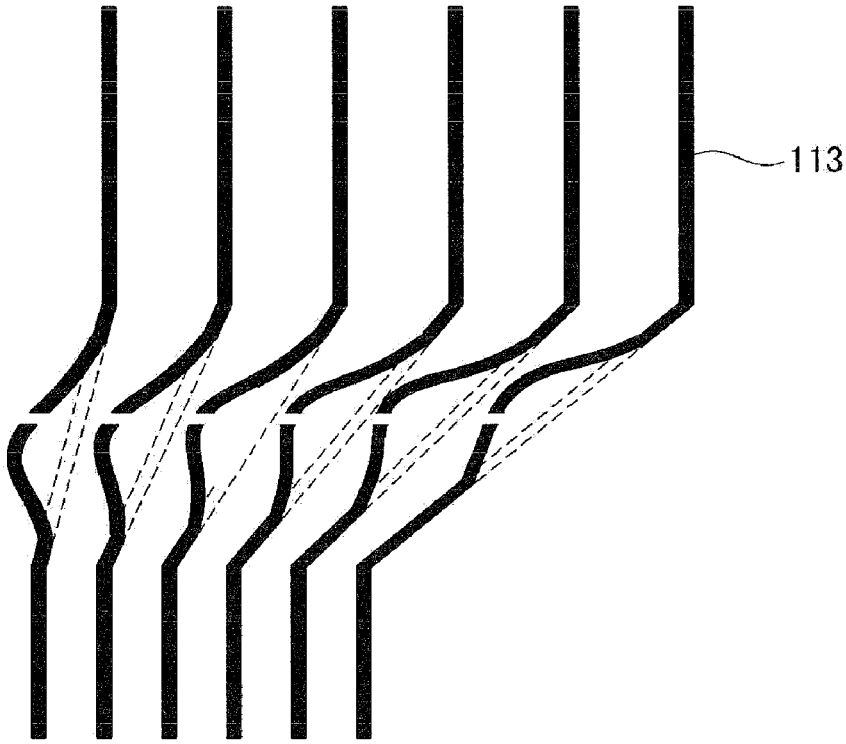

As shown in FIGS. 8 and 9, if the address electrodes 113 are damaged, the quality of an image displayed by the plasma display panel may worsen, or the image may not be displayed on the plasma display panel.

As shown in FIG. 5, if the sealant 200 includes the beads 210, the problems illustrated in FIGS. 8 and 9 may be more frequently generated because the beads 210 apply a pressure to the address electrodes 113.

On the other hand, when the ratio T2/T1 is 0.846 to 0.998, the electrode deformation characteristic is excellent. Because the second portion is sufficiently thick, the sealant 200 or the beads included in the sealant 200 may be sufficiently suppressed from applying the pressure to the address electrodes 113. Therefore, the address electrodes 113 may be sufficiently prevented from being damaged.

When the ratio T2/T1 is 0.538 to 0.753, the electrode deformation characteristic is good.

Considering the above description, the first thickness T1 and the second thickness T2 may satisfy the following equation: $0.538 \leqq T2/T1 \leqq 0.995$. Further, the first thickness T1 and the second thickness T2 may satisfy the following equation: $0.846 \leqq T2/T1 \leqq 0.995$.

Figure 10:
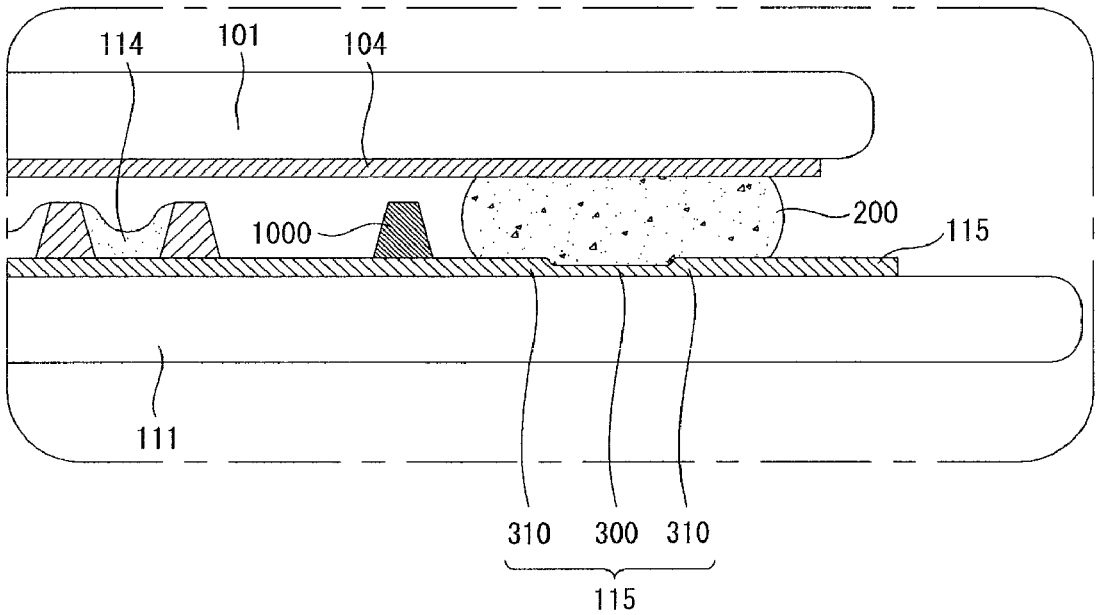
FIG. 10 illustrates a dummy barrier rib.

FIG. 10 illustrates a dummy barrier rib.

As shown in FIG. 10, a dummy barrier rib 1000 may be positioned between the second portion 300 and the barrier rib 112 in a direction parallel to the sealant 200.

The dummy barrier rib 1000 may prevent a sealant material from being penetrated in the active area when the sealant 200 is formed. Even if the sealant 200 is formed using the sealant material with a low viscosity, the dummy barrier rib 1000 may prevent the sealant material from being penetrated in the active area.

Figure 11:
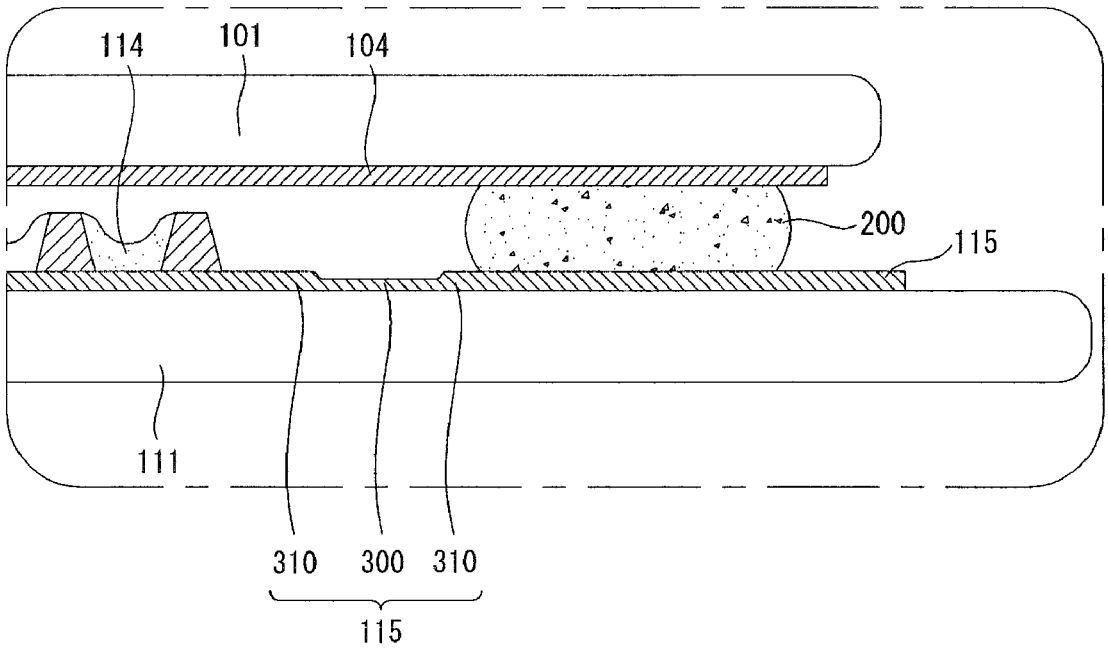
FIG. 11 illustrates changes in a position of a second portion.

FIG. 11 illustrates changes in a position of the second portion.

As shown in FIG. 11, the second portion 300 may be positioned between the sealant 200 and the barrier rib 112.

When the second portion 300 is positioned between the sealant 200 and the barrier rib 112, the address electrodes under the second portion 300 may be prevented from being received the pressure resulting from the sealant 200 or the beads.

Figure 12:
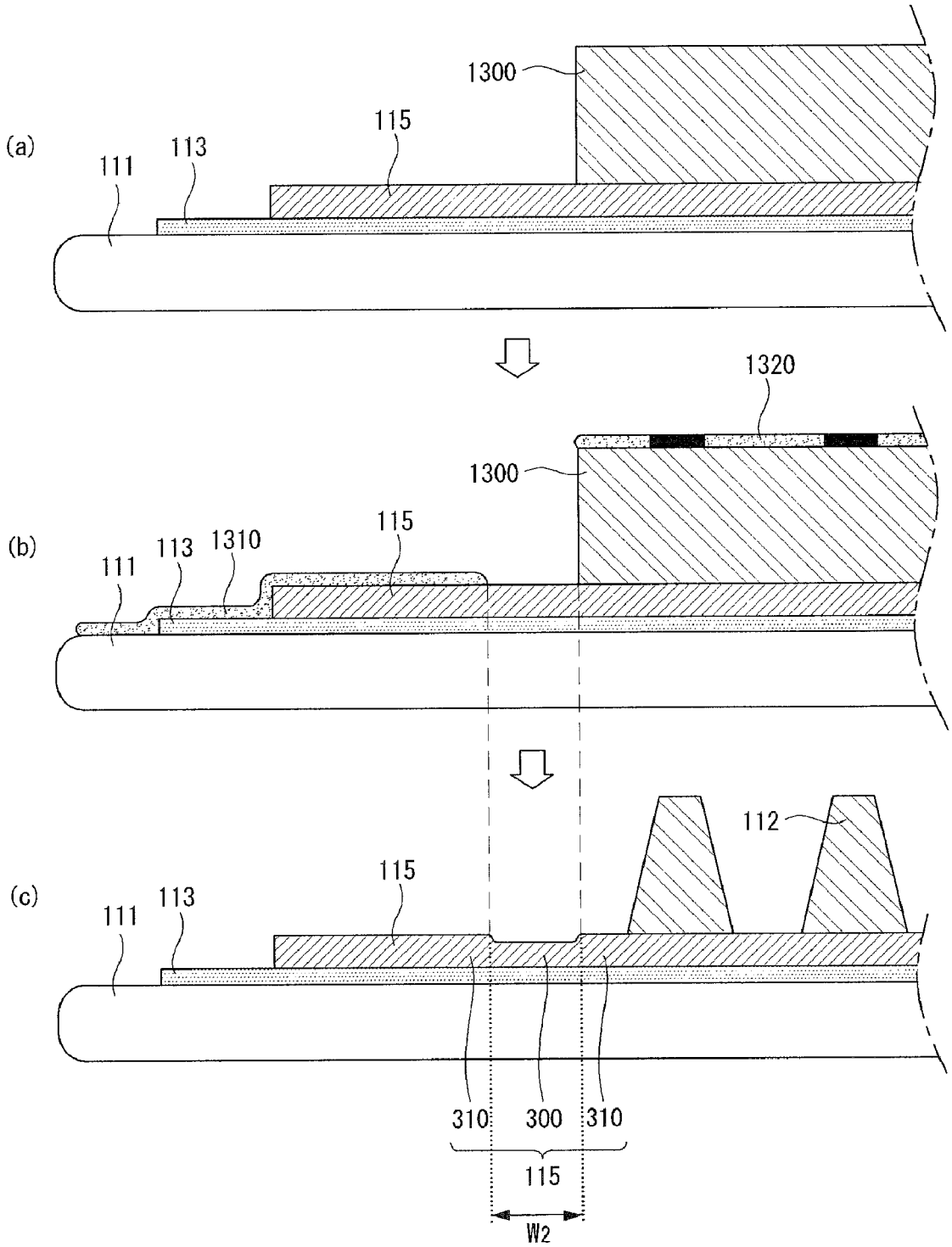
FIG. 12 illustrates an exemplary method for forming a second portion.

FIG. 12 illustrates an exemplary method for forming the second portion.

As shown in (a) of FIG. 12, after the address electrodes 113 and the lower dielectric layer 115 are formed on the rear substrate 111, a barrier layer 1300 may be formed on the lower dielectric layer 115. A laminating method using a green sheet may be used to form the barrier layer 1300

As shown in (b) of FIG. 12, a protective film 1310 may be formed on the address electrodes 113 and the lower dielectric layer 115. A photosensitive film 1320 may be formed on the barrier layer 1300 to expose the barrier layer 1300. The protective film 1310 and the photosensitive film 1320 may be positioned to be spaced apart from each other with an interval W2 therebetween.

As shown in (c) of FIG. 12, a portion of the barrier layer 1300 may be etched through an etching process, thereby forming the barrier rib 112. Further, because a portion of the lower dielectric layer 115 is exposed in an area between the protective film 1310 and the photosensitive film 1320, the exposed portion is together etched when the barrier layer 1300 is etched. Hence, the second portion 300 may be formed.

As above, the second portion 300 may be formed through only a simple process, in which the lower dielectric layer 115 of the area (corresponding to the interval W2) between the protective film 1310 and the photosensitive film 1320 is together etched during the etching process of the barrier layer 1300.

Because the second portion 300 is formed by partially etching the lower dielectric layer 115, it is advantageous that the lower dielectric layer 115 has a relatively high etching resistance. If the etching resistance of the lower dielectric layer 115 is relatively low, the portion of the lower dielectric layer 115 may be excessively etched. Hence, the second portion 300 may be very thin or the address electrode 113 may be exposed.

Accordingly, the lower dielectric layer 115 may include a glass frit including the following composition.

A dielectric composition for the lower dielectric layer 115 may include about 50 to 70 parts by weight of a glass frit based on total weight of the dielectric composition.

The glass frit may include about 55 to 80 parts by weight of lead oxide (PbO), about 1 to 10 parts by weight of aluminum oxide ($Al_2O_3$), about 1 to 9 parts by weight of boron oxide ($B_2O_3$), about 8 to 40 parts by weight of silicon oxide ($SiO_2$), and about 0.1 to 12 parts by weight of bismuth oxide ($Bi_2O_3$) based on 100 parts by weight of the glass frit. The glass frit may further include at least one of about 0.5 to 10 parts by weight of lithium oxide ($Li_2O$), about 0.1 to 2 parts by weight of copper oxide (CuO), and about 0.5 to 3.5 parts by weight of cerium oxide ($Ce_2O$) based on 100 parts by weight of the glass frit. The glass frit may further include at least one of about 1 to 12 parts by weight of phosphorus oxide ($P_2O_5$), about 0.5 to 10 parts by weight of natrium oxide ($Na_2O$), and about 7 to 12 parts by weight of potassium oxide ($K_2O$) based on 100 parts by weight of the glass frit.

The dielectric composition may include about 55 to 80 parts by weight of PbO based on 100 parts by weight of the glass frit. PbO is a principal component constituting a glass and may play a part in lowering a firing temperature of the dielectric composition and increasing a thermal expansion coefficient. More specifically, when PbO content based on 100 parts by weight of the glass frit is equal to or greater than 55 parts by weight, the firing temperature of the dielectric composition may be lowered, and thus process time may be reduced. When PbO content based on 100 parts by weight of the glass frit is equal to or less than 80 parts by weight, the firing temperature of the dielectric composition may be prevented from being lowered and the thermal expansion coefficient may be prevented from increasing.

The dielectric composition may include about 1 to 10 parts by weight of $Al_2O_3$ based on 100 parts by weight of the glass frit. $Al_2O_3$ may play a part in improving mechanical and chemical stability of the dielectric composition by reducing a thermal expansion coefficient and increasing a high temperature viscosity. More specifically, when $Al_2O_3$ content based on 100 parts by weight of the glass frit is equal to or greater than 1 part by weight, the thermal expansion coefficient may be reduced and the mechanical and chemical stability of the dielectric composition may be improved. When $Al_2O_3$ content based on 100 parts by weight of the glass frit is equal to or less than 10 parts by weight, the thermal expansion coefficient and a viscosity behavior in a firing region may be proper.

The dielectric composition may include about 1 to 9 parts by weight of $B_2O_3$ based on 100 parts by weight of the glass frit. $B_2O_3$ may play a part in forming a network structure of the dielectric composition. More specifically, when $B_2O_3$ content based on 100 parts by weight of the glass frit is equal to or greater than 1 part by weight, the network structure of the dielectric composition may be fully formed. When $B_2O_3$ content based on 100 parts by weight of the glass frit is equal to or less than 9 parts by weight, a rise in a glass transition temperature of the dielectric composition may be prevented.

The dielectric composition may include about 8 to 40 parts by weight of $SiO_2$ based on 100 parts by weight of the glass frit. $SiO_2$ serving as a glass forming component may play a part in chemically and optically stabilizing a glass and in greatly raising a glass transition temperature and a glass softening temperature of the dielectric composition. More specifically, when $SiO_2$ content based on 100 parts by weight of the glass frit is equal to or greater than 8 parts by weight, the dielectric composition may be chemically and optically stabilized. When $SiO_2$ content based on 100 parts by weight of the glass frit is equal to or less than 40 parts by weight, an excessive rise in the glass transition temperature can be prevented.

The dielectric composition may include about 0.1 to 12 parts by weight of $Bi_2O_3$ based on 100 parts by weight of the glass frit. $Bi_2O_3$ may play a part in lowering a melting temperature and a glass transition temperature of the dielectric composition. More specifically, when $Bi_2O_3$ content based on 100 parts by weight of the glass frit is equal to or greater than 0.1 part by weight, the melting temperature may be lowered. When $Bi_2O_3$ content based on 100 parts by weight of the glass frit is equal to or less than 12 parts by weight, color reversion of the glass may be prevented.

The lower dielectric layer 115 with the excellent etching resistance may be formed using the glass frit having the above-described composition. Hence, the second portion 300 may be prevented from being excessively thin.

As described above, because the plasma display panel according to the exemplary embodiments includes the dielectric layer including the two portions each having a different thickness, the attachment strength between the front substrate and the rear substrate can be improved and the structural reliability of the plasma display panel can be improved.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A plasma display panel comprising:

a front substrate;

a rear substrate facing the front substrate, the rear substrate including a dielectric layer thereon;

barrier ribs positioned in an active area; and a sealant disposed between the front substrate and the rear substrate in a dummy area, wherein the dielectric layer in the dummy area includes a first portion having a first thickness T1 and a second portion having a second thickness T2, and wherein the first thickness T1 and the second thickness T2 substantially satisfy the following equation: $0.538 \leqq T2/T1 \leqq 0.995$.

2. The plasma display panel of claim 1, wherein the first thickness T1 is greater than the second thickness T2.

3. The plasma display panel of claim 1, wherein the sealant includes a plurality of beads.

4. The plasma display panel of claim 1, wherein the first thickness T1 is substantially equal to a thickness of the dielectric layer in the active area.

5. The plasma display panel of claim 1, wherein the sealant directly contacts the second portion.

6. The plasma display panel of claim 1, wherein the second portion is disposed between the sealant and the barrier ribs.

7. The plasma display panel of claim 1, further comprising dummy barrier ribs between the second portion and the barrier ribs.

8. The plasma display panel of claim 1, wherein the dielectric layer includes a glass frit, wherein the glass frit includes about 55 to 80 parts by weight of lead oxide (PbO), about 1 to 10 parts by weight of aluminum oxide ($Al_2O_3$), about 1 to 9 parts by weight of boron oxide ($B_2O_3$), about 8 to 40 parts by weight of silicon oxide ($SiO_2$), and about 0.1 to 12 parts by weight of bismuth oxide ($Bi_2O_3$) based on 100 parts by weight of the glass frit.

9. The plasma display panel of claim 1, wherein the first thickness T1 and the second thickness T2 substantially satisfy the following equation: $0.846 \leqq T2/T1 \leqq 0.995$.

10. The plasma display panel of claim 1, wherein the sealant contacts both the first portion and the second portion.

11. A plasma display panel comprising:

a first substrate;

a second substrate facing the first substrate, wherein a dielectric layer is provided on the second substrate;

a plurality of barrier ribs in an active area; and a sealant in a dummy area between the first substrate and the second substrate, wherein the dielectric layer includes a first portion in the dummy area having a first thickness T1 and a second portion in the dummy area having a second thickness T2, and wherein the first thickness T1 and the second thickness T2 substantially satisfy the following equation: $0.538 \leqq T2/T1 \leqq 0.995$.

12. The plasma display panel of claim 11, wherein the first thickness T1 is greater than the second thickness T2.

13. The plasma display panel of claim 11, wherein the sealant includes a plurality of beads.

14. The plasma display panel of claim 11, wherein the first thickness T1 is substantially equal to a thickness of the dielectric layer in the active area.

15. The plasma display panel of claim 11, wherein the sealant directly contacts the second portion.

16. The plasma display panel of claim 11, wherein the second portion is between the sealant and the barrier ribs.

17. The plasma display panel of claim 11, further comprising dummy barrier ribs between the second portion and the barrier ribs.

18. The plasma display panel of claim 11, wherein the dielectric layer includes a glass frit, wherein the glass frit includes about 55 to 80 parts by weight of lead oxide (PbO), about 1 to 10 parts by weight of aluminum oxide ($Al_2O_3$), about 1 to 9 parts by weight of boron oxide ($B_2O_3$), about 8 to 40 parts by weight of silicon oxide ($SiO_2$), and about 0.1 to 12 parts by weight of bismuth oxide ($Bi_2O_3$) based on 100 parts by weight of the glass frit.

19. The plasma display panel of claim 11, wherein the sealant contacts both the first portion and the second portion.

20. A plasma display panel comprising:

a first substrate;

a second substrate facing the first substrate, wherein a dielectric layer is provided on the second substrate;

a plurality of barrier ribs in an active area; and a sealant in a dummy area between the first substrate and the second substrate, wherein the dielectric layer includes a first portion in the dummy area having a first thickness T1 and a second portion in the dummy area having a second thickness T2, and wherein the first thickness T1 and the second thickness T2 substantially satisfy the following equation: $0.846 \leqq T2/T1 \leqq 0.995$.

* * * * *